US007770272B2

(12) United States Patent
Lin

(10) Patent No.: US 7,770,272 B2
(45) Date of Patent: Aug. 10, 2010

(54) CLAMPING-EFFECTIVE YARN CYLINDER

(76) Inventor: Ying-Ling Lin, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 12/206,745

(22) Filed: Sep. 9, 2008

(65) Prior Publication Data

US 2010/0058811 A1 Mar. 11, 2010

(51) Int. Cl.
*B65H 55/00* (2006.01)

(52) U.S. Cl. ..... 28/290; 242/172

(58) Field of Classification Search ..... 66/1 R; 28/289, 290, 291; 242/172, 173
See application file for complete search history.

(56) References Cited

U.S. PATENT DOCUMENTS 3,095,161 A * 6/1963 Atwood et al. ..... 242/159
3,103,305 A * 9/1963 Heatherly ..... 225/6
3,794,260 A * 2/1974 Sowell ..... 242/125.1
4,907,758 A * 3/1990 Powel et al. ..... 242/125.1
5,211,354 A * 5/1993 Rummage ..... 242/125.1
5,495,087 A * 2/1996 Rummage ..... 219/69.15
5,558,288 A * 9/1996 Brovelli ..... 242/172
5,702,063 A * 12/1997 Bottari ..... 242/125.2
6,779,750 B1 * 8/2004 Couchey et al. ..... 242/476.6
7,114,227 B2 * 10/2006 Lin ..... 28/290

* cited by examiner

*Primary Examiner*—Danny Worrell

(57) ABSTRACT

A clamping-effective yarn cylinder comprises a yarn cylinder having a trench about 350 degrees around an outer periphery of the yarn cylinder; each of two ends of the trench being formed with a cambered wall; the trench being divided into four sections so that four molds can enter into the trench from the four sections which are divided by four radius lines; each section having teeth which are tilt to different directions so as to enhance the force for clamping the yarns; and the teeth for each section extending from two lateral walls of the section and having identical orientation; extensions of the teeth of adjacent sections will intersect to one another so that yarns can be captured effectively in the trench.

1 Claim, 4 Drawing Sheets

CLAMPING-EFFECTIVE YARN CYLINDER

FIELD OF THE INVENTION

The present invention relates to yarn cylinders, and particularly to a clamping-effective yarn cylinder, which includes a trench having four sections. In manufacturing process, the molds can retract from four section. Each section has teeth. Extensions of the teeth of adjacent sections will intersect to one another so that yarns can be captured effectively in the trench.

BACKGROUND OF THE INVENTION

Referring to FIG. 1, a prior art yarn cylinder illustrated in U.S. Pat. No. 7,114,227 assigned to the inventor and applicant of the present invention is disclosed. As conveyed by the drawings, the prior art improves the circumferential length of the trench 1 and, furthermore, postures the teeth 10 in the trench 1 at differing angular orientations; specifically, the teeth 10 are disposed at varying inclinations along the two lateral walls of the trench 10 and, furthermore, the teeth 10 are in a crisscross formation on the two lateral walls; as such, the longer circumferential length of the trench 10 and the contrastive skewing of the teeth 10 effectively increases yarn end snagging capacity. When yarn a is wound in the trench 1, it is caught on plurality of teeth 10 arrayed in the crisscross formation, the many differing angles of the plurality of teeth 10 in the crisscross formation situating the teeth 10 for interlocking utilization such that the yarn cylinder trench 1 not only better accommodates and binds the end of the yarn, but at the same time the interlocking characteristics secures the yarn more effectively.

However inventor find finds that the prior art can still be improved so that the yarns can be clamped in the trench effectively.

SUMMARY OF THE INVENTION

Accordingly, the primary object of the present invention is to provide a clamping-effective yarn cylinder, which includes a trench having four sections. In manufacturing process, the molds can retract from four section. Each section has teeth. Extensions of the teeth of adjacent sections will intersect to one another so that yarns can be captured effectively in the trench.

To achieve above objects, the present invention provides a clamping—effective yarn cylinder comprises a yarn cylinder having a trench about 350 degrees around an outer periphery of the yarn cylinder; each of two ends of the trench being formed with a cambered wall; the trench being divided into four sections so that four molds can enter into the trench from the four sections which are divided by four radius lines; each section having teeth which are tilt to different directions so as to enhance the force for clamping the yarns; and the teeth for each section extending from two lateral walls of the section and having identical orientation; extensions of the teeth of adjacent sections will intersect to one another so that yarns can be captured effectively in the trench.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
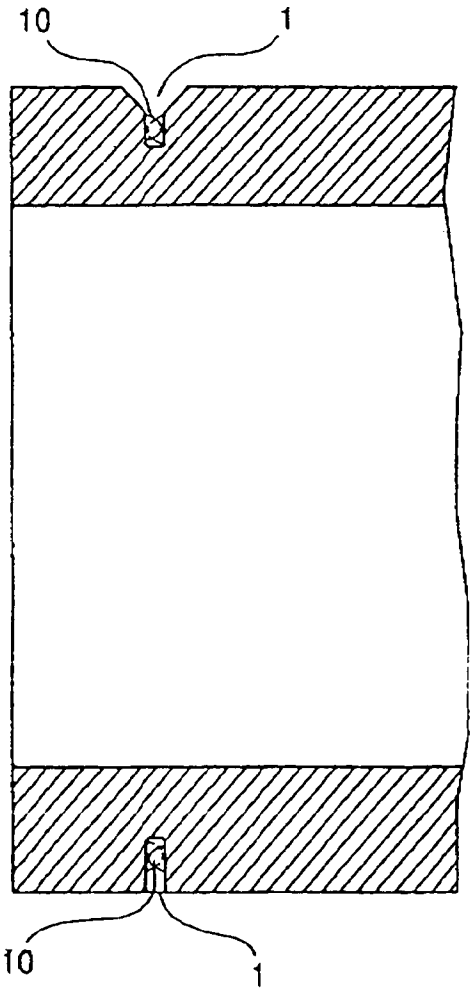
Fig. 1 (PRIOR ART)
FIG. 1 is a longitudinal cross sectional view of the prior art yarn cylinder.
Figure 2:
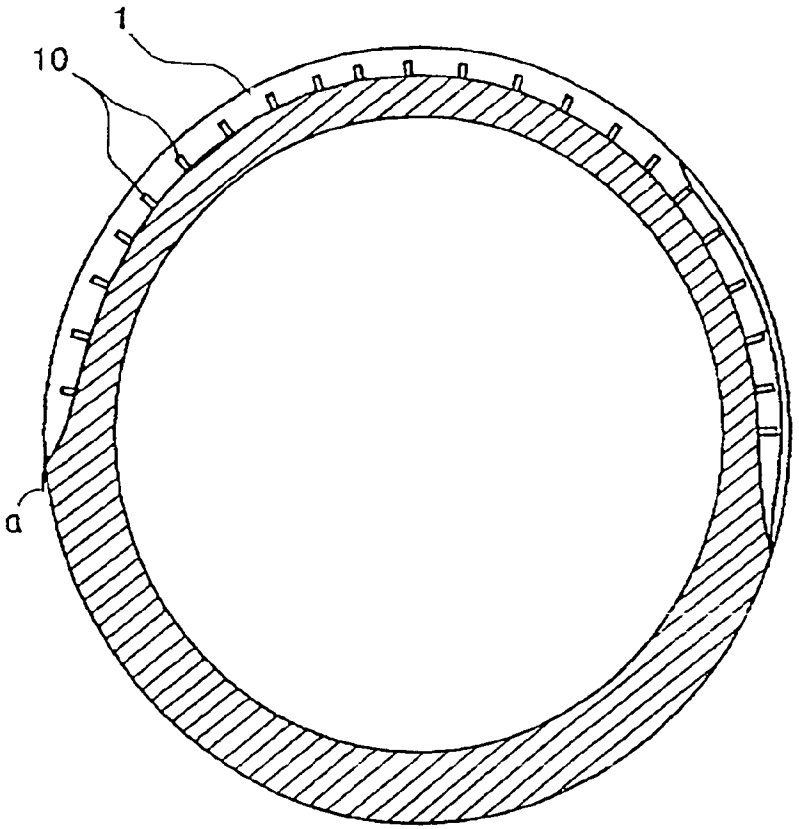
Fig. 2 (PRIOR ART)
FIG. 2 is a transversal cross sectional view of the prior art yarn cylinder.
Figure 3:
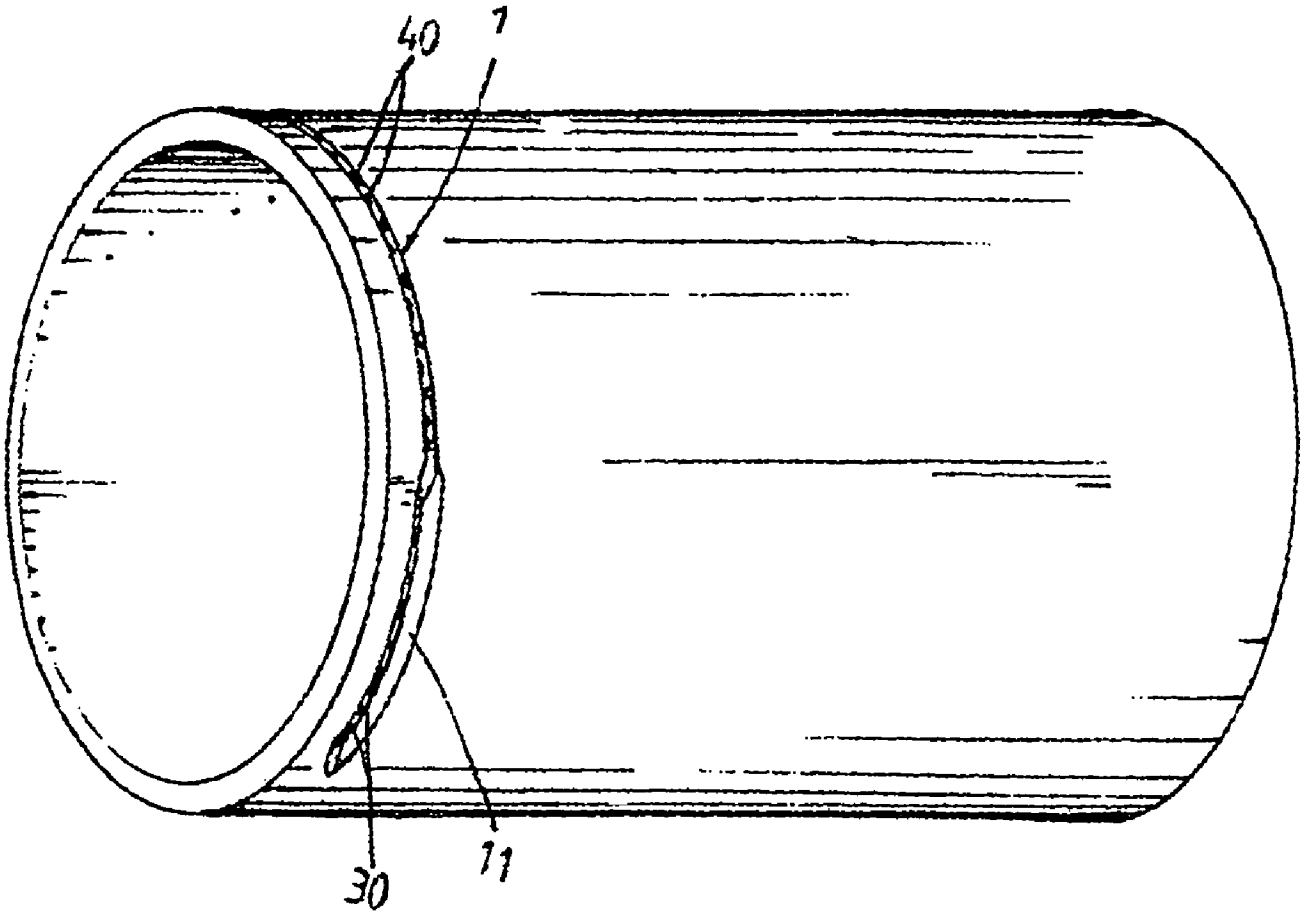
FIG. 3 is a schematic view of the present invention.
Figure 5:
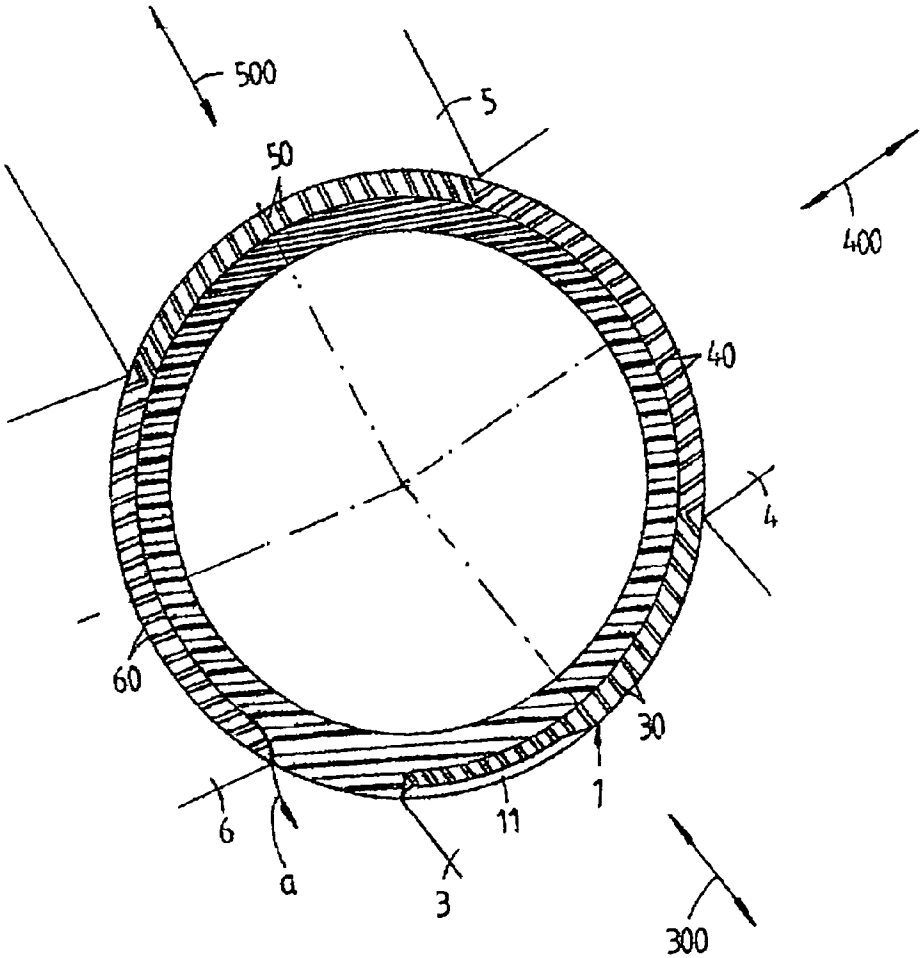
FIG. 5 is a schematic view showing the clamping the yarn in the present invention.
Figure 4:
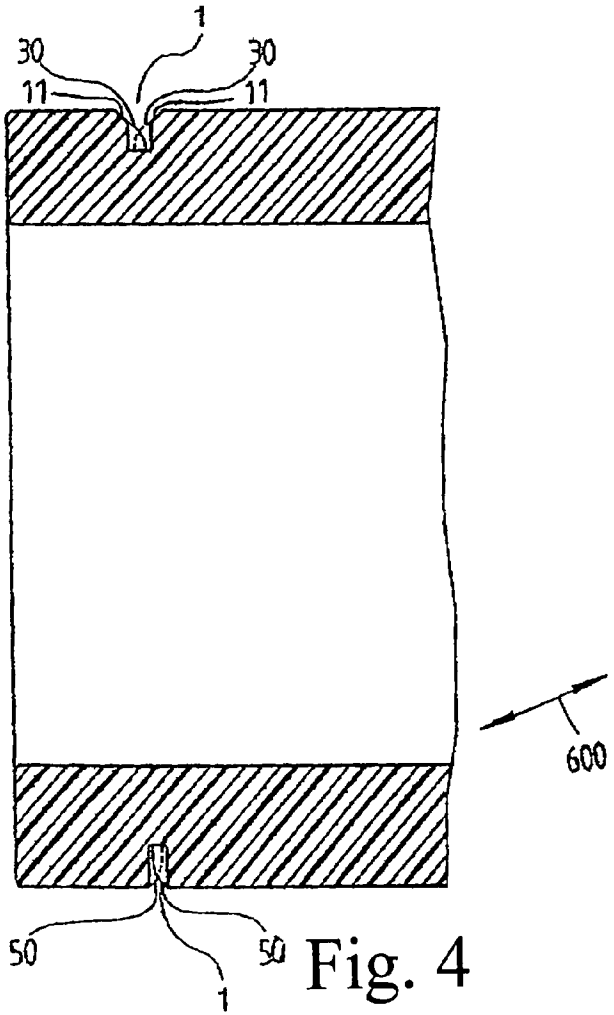
FIG. 4 is a longitudinal cross sectional view of the present invention.

Referring to FIGS. 3 to 5, the structure of the present invention is illustrated. In the present invention, a yarn cylinder has a trench 1 about 350 degrees around an outer periphery of the yarn cylinder. Each of two ends of the trench 1 is formed with a cambered wall 11. The trench 1 is divided into four sections 3, 4, 5 and 6 so that four molds can enter into the trench 1 from the four sections 3, 4, 5 and 6 which are divided by radius lines 300, 400, 500 and 600. Each section 3, 4, 5, and 6 has teeth 30, 40 50, and 60 which are tilt to different directions so as to enhance the force for clamping the yarns.

Figure 6:
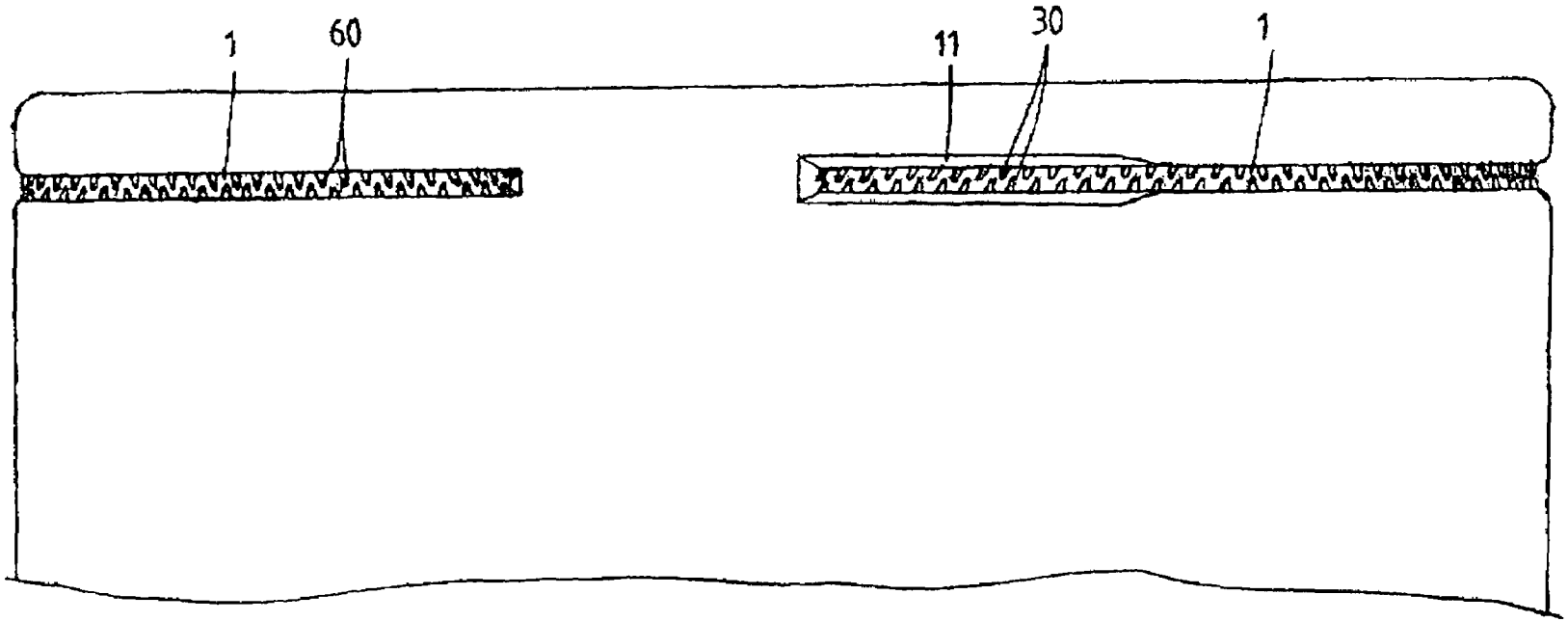
FIG. 6 is an elevational view of the present invention.

Referring to FIG. 6, it is illustrated that the teeth for each section extends from two lateral walls of the section and have identical orientation. Extensions of the teeth of adjacent sections (30, 40), (40, 50), (50, 60) and (60, 30) will intersect to one another, as shown in FIG. 5 so that yarns can be captured effectively in the trench 1. Furthermore, in the manufacturing process, four molds can retract along the four radius lines 300, 400, 500 and 600 and the teeth 30, 40 50, and 60 are also formed at the same time. Thus the present invention can greatly reduce the manufacturing cost of the yarn cylinder and the clamping force to the yarn is greatly increased.

The operation of the present invention will be described herein. Firstly, the yarns enter into the ends of the trench 1 along the cambered wall. Then the yarns wind around the trench 1 through the sections 3, 4, 5 and 6 and are captured by the teeth 30, 40, 50 and 60. Thus the yarns are impossible to release from the yarn cylinder so that the yarns will slide along the yarn cylinder and the yarns can be wound quickly and effectively.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A clamping-effective yarn cylinder, comprising: a yarn cylinder having a trench formed with two lateral walls and two ends and extending about 350 degrees around an outer periphery of the yarn cylinder; each of the two ends of the trench being formed with a cambered wall; the trench being molded into four separate sections divided by four radial lines; each section having teeth which are tilted in different directions so as to enhance a clamping force on the yarn; the teeth for each section extending from the two lateral walls of each section and having identical orientations; the teeth of adjacent sections further comprising extensions which intersect one another so that yarns can be captured effectively within the trench.

* * * * *